US008261671B2

(12) United States Patent
Sakanoue et al.

(10) Patent No.: US 8,261,671 B2
(45) Date of Patent: Sep. 11, 2012

(54) BOGIE LATERAL MOVEMENT-LIMITING SYSTEM

(75) Inventors: Kei Sakanoue, Nagoya (JP); Yoshinori Minami, Nagoya (JP); Toshiki Kunii, Nagoya (JP); Nobuhisa Takada, Nagoya (JP)

(73) Assignees: Central Japan Railway Company, Nagoya-shi (JP); Nippon Sharyo, Ltd., Nagoya-shi (JP)

( * ) Notice: Subject to any disclaimer, the term of this patent is extended or adjusted under 35 U.S.C. 154(b) by 543 days.

(21) Appl. No.: 12/225,102

(22) PCT Filed: Mar. 12, 2007

(86) PCT No.: PCT/JP2007/054784

§ 371 (c)(1),
(2), (4) Date: Feb. 4, 2009

(87) PCT Pub. No.: WO2007/105672

PCT Pub. Date: Sep. 20, 2007

(65) Prior Publication Data

US 2009/0301343 A1 Dec. 10, 2009

(30) Foreign Application Priority Data

Mar. 13, 2006 (JP) ..... 2006-066974

(51) Int. Cl.
*B61F 9/00* (2006.01)
*E01B 5/18* (2006.01)

(52) U.S. Cl. ..... 105/216; 104/242; 238/17

(58) Field of Classification Search ..... 104/242, 104/243, 244, 248, 259; 105/216, 217; 238/17–23
See application file for complete search history.

(56) References Cited

U.S. PATENT DOCUMENTS

| | | | | | |
|---|---|---|---|---|---|
| 187,761 | A | * | 2/1877 | Johnson | 104/243 |
| 604,513 | A | * | 5/1898 | Beasley | 104/248 |
| 735,239 | A | * | 8/1903 | Gehricke et al. | 105/216 |
| 1,093,157 | A | * | 4/1914 | Stephenson | 238/20 |
| 1,490,781 | A | * | 4/1924 | Marshall | 105/216 |
| 1,626,610 | A | * | 5/1927 | Hornquist | 105/216 |
| 1,939,560 | A | * | 12/1933 | Maney | 238/20 |

FOREIGN PATENT DOCUMENTS

| | | |
|---|---|---|
| FR | 2 755 658 A1 | 5/1998 |
| JP | 10-250576 | 9/1998 |
| JP | 3393032 | 9/1998 |
| JP | 11-036201 | 2/1999 |
| JP | 3119047 | 1/2006 |
| JP | 2006-063790 | 3/2006 |

OTHER PUBLICATIONS

International Search Report mailed Jun. 12, 2007, issued on PCT/JP2007/054784.

(Continued)

*Primary Examiner* — S. Joseph Morano
*Assistant Examiner* — Zachary Kuhfuss
(74) *Attorney, Agent, or Firm* — Edwards Wildman Palmer LLP

(57) ABSTRACT

A bogie lateral movement-limiting system capable of effectively restricting the lateral movement of a derailed bogie. The system comprises derailment prevention guards (62*a*, 62*b*) laid along the inside of paired left and right rails, and a lateral movement-limiting device (52) installed on the lower part of the bogie (30). The device (52) has a stopper (51) projecting downward at a position between the wheels of the bogie and slidingly contacts with the inner surfaces of the derailment prevention guards (62*a*, 62*b*) in case of a derailment of bogie.

6 Claims, 21 Drawing Sheets

OTHER PUBLICATIONS

Office Action mailed Mar. 21, 2012, issued for the corresponding Japanese patent application No. 2008-505128 and English translation thereof.

Supplemental European Search Report dated Jun. 11, 2012 issued for the corresponding European Patent Application No. 07738256.2.

* cited by examiner

30

BOGIE LATERAL MOVEMENT-LIMITING SYSTEM

TECHNICAL FIELD

The present invention relates to a bogie lateral movement-limiting system, and particularly relates to a bogie lateral movement-limiting system capable of preventing an occurrence of a second disaster by restricting lateral movements of bogies in case of a derailment due to an earthquake or a gust, etc.

BACKGROUND ART

An overturn prevention system has been proposed, which provides at a lower part of an axle box with a stopper device for restraining a vehicle in case of a derailment so that the vehicle is not brought to contact with tracks (rails) and is not displaced in the lateral direction; as a device for preventing a vehicle from overturning in case of derailment due to a natural disaster, such as an earthquake and a gust, by guiding the vehicle to travel on ballast with sleepers or on roadbed, etc. (For example, refer to the Patent Article 1.)

[Patent Article 1] The Japanese Publication Patent No. 3393032

DISCLOSURE OF THE INVENTION

Problems to be Solved by the Invention

However, the turnover prevention system as explained above requires the high strength for the axle box to be attached with the stopper device, therefore, the overall weight of the bogie increases; the riding comfort may be adversely affected as the unsprung weight increases; and, furthermore, the rails may be damaged when passing through a point or a turnout.

In consideration of the above circumstances, the present invention has an object thereof to provide a bogie lateral movement-limiting system capable of effectively restricting lateral movements of a derailed bogie with a simple structure and, particularly, capable of preventing a second disaster by limiting a lateral movement amount of the vehicle body to be within a range of being able to prevent a collision with the opposite train on the double track.

Means for Solving the Problems

The bogie lateral movement-limiting system of the present invention is the system for restricting lateral movements of a bogie when a vehicle traveling on paired right and left rails is derailed. The system comprises a derailment prevention guard device laid inside of the paired rails and a lateral movement-limiting device attached to a lower part of the bogie. The lateral movement-limiting device has a stopper which extends downward from a position inside of wheels of the bogie and is brought to a slide-contact with an inner surface of the derailment prevention device in case of derailment. The stopper is provided within a clearance limit for rolling stock and the derailment prevention guard is provided within a construction gauge. The stopper is adjustable to the downward direction.

A bogie lateral movement-limiting device of the present invention is the device for restricting lateral movements of a bogie by slidingly contacting with a derailment prevention guards laid inside of paired rails in case of a vehicle derailment. The lateral movement-limiting device comprises a stopper which is attached to a lower part of the bogie and has a projection extended downward from a position inside wheels of the bogie, and the projection is brought to a slide-contact with an inner surface of the derailment prevention guard device in case of derailment. The bogie lateral movement-limiting device comprises an attachment for the stopper provided to a lower part of the bogie and the stopper provided to the attachment, and the stopper is adjustable to the downward direction of the projection thereof. Furthermore, in the bogie lateral movement-limiting device, the stopper is attached to a lower part of the bogie to be able to adjust the vertical position of the projection thereof.

A derailment prevention guard device of the present invention is a pair of right and left derailment prevention guard devices laid respectively along inside of paired rails for restricting lateral movements of a bogie by slidingly contacting with a stopper of a lateral movement-limiting device attached to a lower part of the bogie in case of the vehicle derailment. The derailment prevention guard device comprises a fixing member to be attached to the right and left side of sleepers and a T-shaped guard member attached to an upper part of each fixing member. Heights of the guard members are set to be same or slightly higher than the top of the rails.

Effects of the Invention

According to the bogie lateral movement-limiting system of the present invention, it is easy to provide the stopper within the clearance limit for rolling stock and to provide the derailment prevention guard device within the construction gauge. Also, the derailment prevention guard functions to prevent wheels from being derailed, and, when the wheels are derailed by climbing over the derailment prevention guard, the stopper slidingly contacts with the inner side of the derailment prevention guard and lateral movements can be restricted without interfering traveling of the vehicle. Furthermore, by providing the stopper within the clearance limit for rolling stock gauge and providing the derailment guard within the construction gauge, these stoppers and guards do not interfere the normal traveling of the vehicle. Moreover, by setting a downward projection amount of the stopper adjustable, it is also possible to compensate the wheel wear easily.

DESCRIPTION OF REFERENCES

Figure 1:
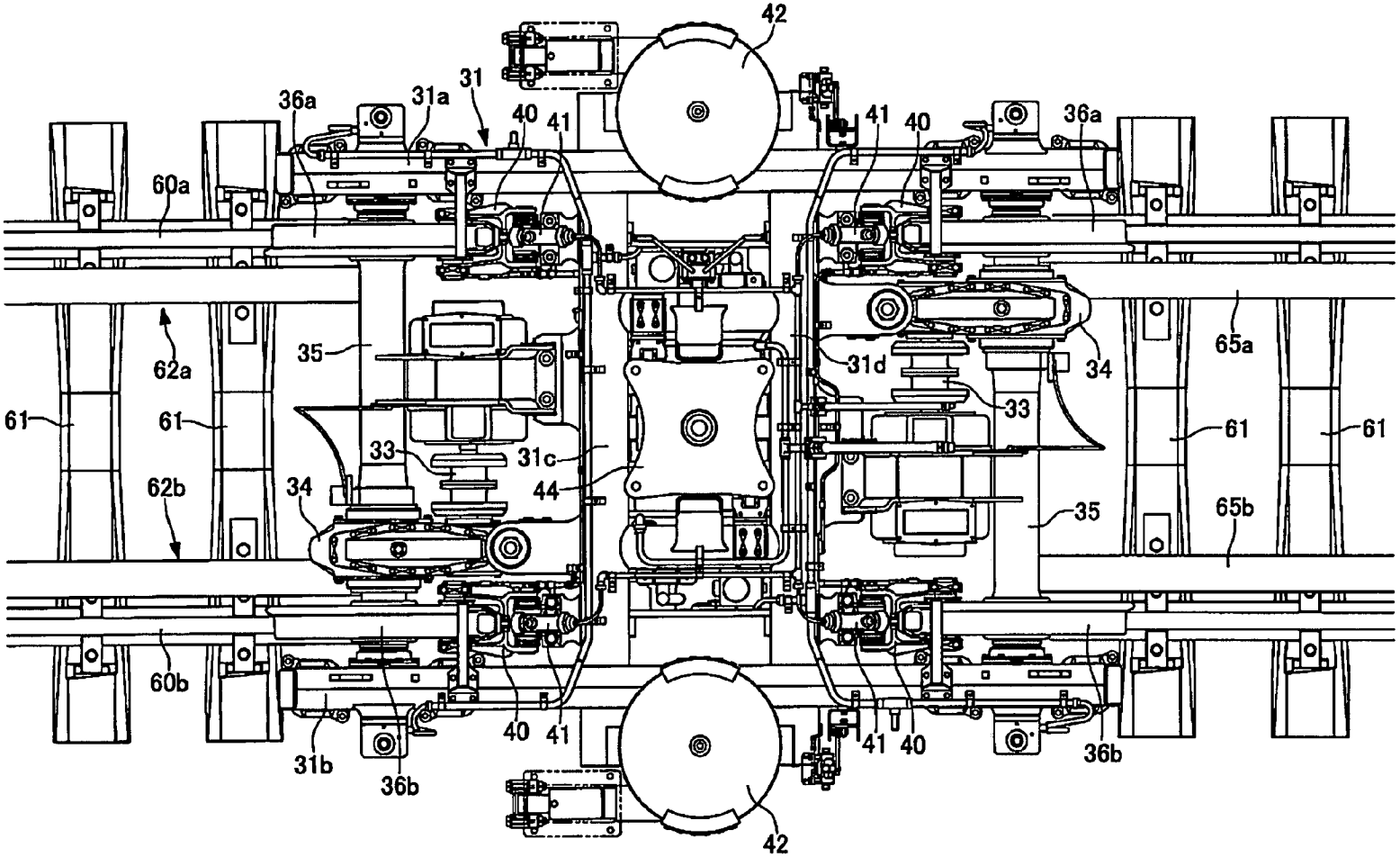
FIG. 1 A plan view showing an embodiment of a driving bogie used in the bogie lateral movement-limiting system of the present invention.

30 . . . bogie
31 . . . bogie frame
31*a*, 31*b* . . . side beam
31*c*, 31*d* . . . cross beam
32 . . . traction motor
35 . . . wheelset
36*a*, 36*b* . . . wheel
43 . . . carbody
43*a* . . . underframe
44 . . . traction device
45 . . . link bracket on carbody
46 . . . link bracket on bogie
47 . . . link
48*a*, 48*b* . . . pin
49*a*, 49*b* . . . rubber bush
50*a*, 50*b* . . . bolt
51 . . . stopper
52 . . . lateral movement-limiting device
51*a* . . . base portion
51*b* . . . projection
51*c* . . . sliding-contact portion
51*d* . . . serration face
L . . . clearance limit for rolling stock
M . . . lateral movement-limiting width

BEST MODE FOR CARRYING OUT THE INVENTION

Figure 2:
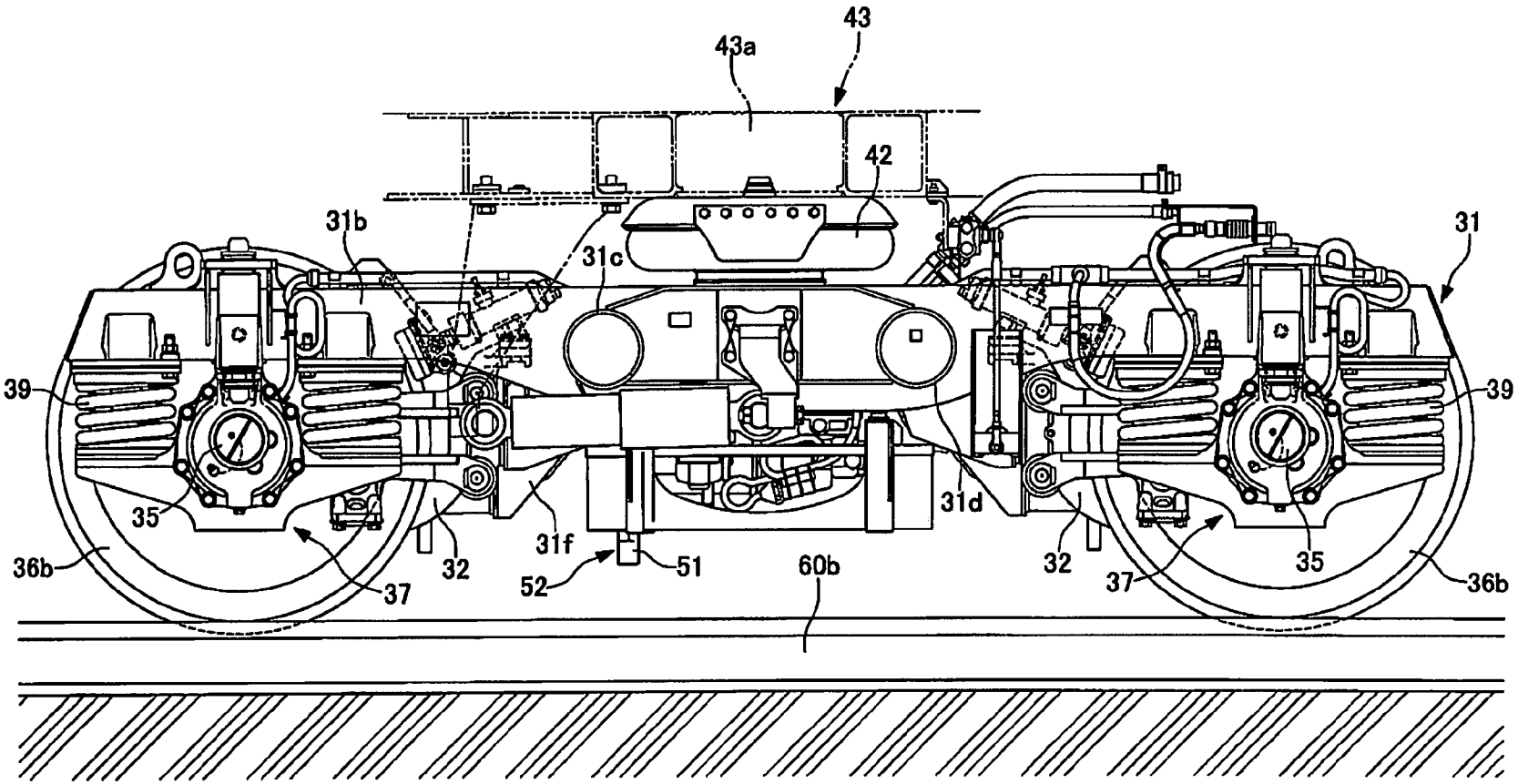
FIG. 2 A side view of FIG. 1.
Figure 3:
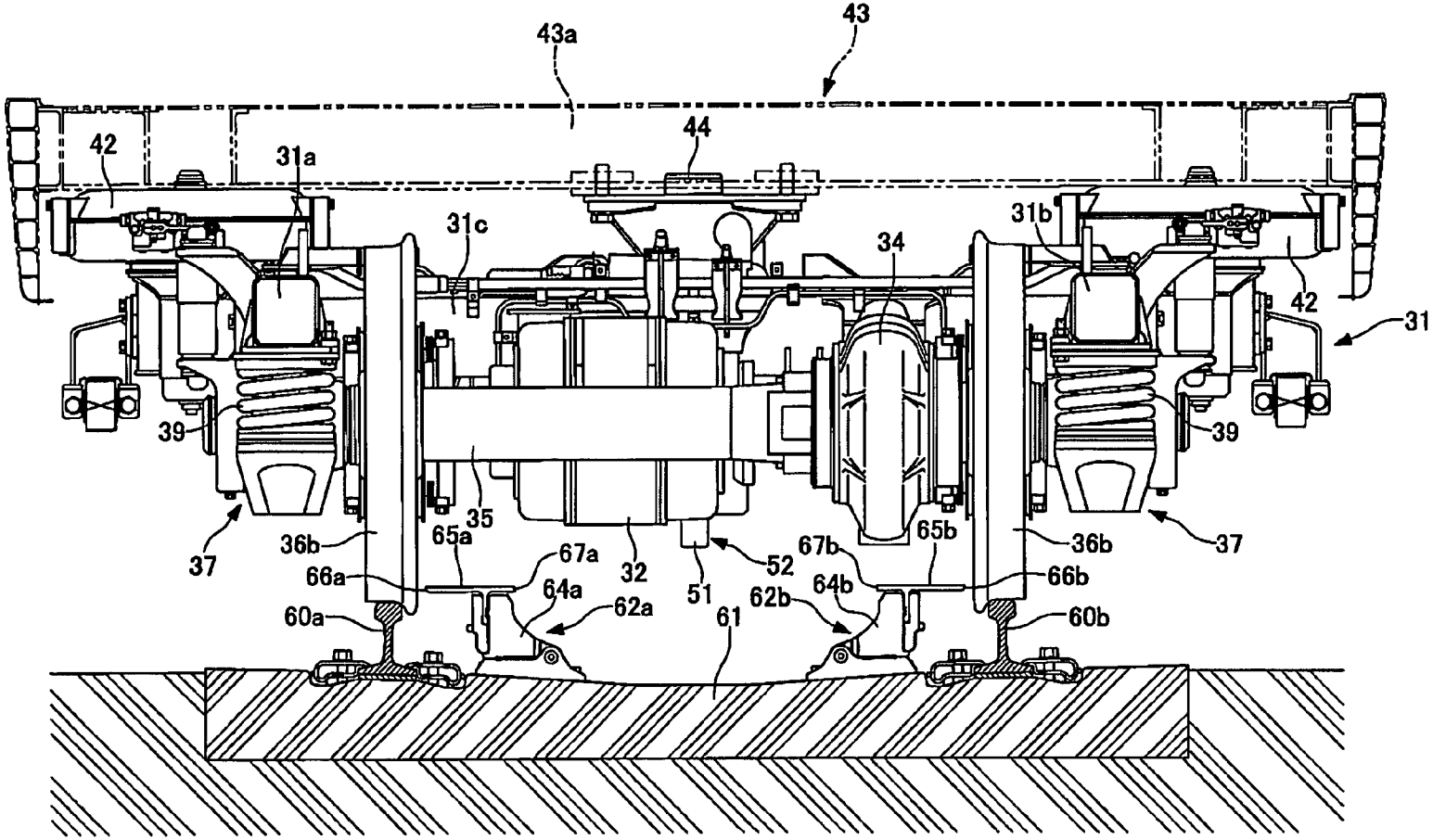
FIG. 3 A front view of FIG. 1.

FIG. 1 to FIG. 3 show an embodiment of a driving bogie used in the bogie lateral movement-limiting system of the present invention: wherein FIG. 1 is a plan view, FIG. 2 is a side view and FIG. 3 is a front view. A bogie 30 shown in the present embodiment is a bolsterless bogie for motor car. In the bogie 30, two side beams 31*a* and 31*b* being in parallel with right and left rails 60*a* and 60*b* and two cross beams 31*c* and 31*d* being in parallel with sleepers 61 compose a bogie frame 31 having a general H shape in a plan view. A traction motor 32 is fixed to each of the cross beams 31*c* and 31*d*. A rotation force of each of the traction motors 32 is transferred to a wheelset 35 and right and left wheels 36*a* and 36*b* via a flexible coupling 33 and a gear unit 34. On both end portions of the side beams 31*a* and 31*b*, axle boxes are provided to support both end portions of the wheelset 35. Axle springs 39 are provided between each axle box 37 and the side beams 31*a* and 31*b*. The cross beams 31*c* and 31*d* are provided with disc brake devices 40 in accordance with the respective wheels 36*a* and 36*b*. Each of the disc brake devices 40 is provided with a wheel tread cleaning device 41 to clean the tread of each of the wheels 36*a* and 36*b*. On the bogie frame 31, a carbody 43 is mounted via bolster springs 42 and 42, and the bogie 30 and the carbody 43 are connected together by a means of traction device 44 for transmitting a driving force and a braking force.

Figure 4:
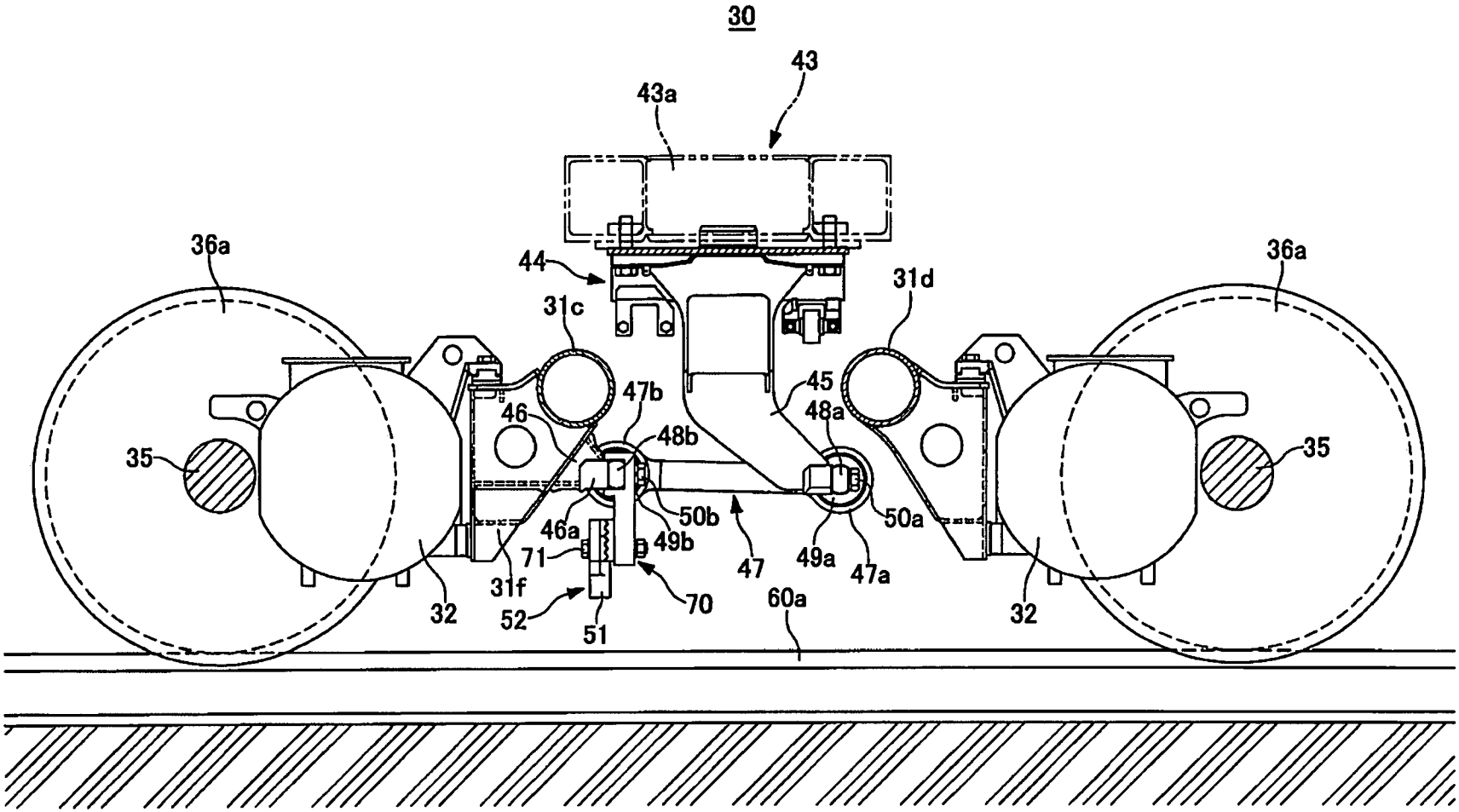
FIG. 4 A side view showing a schematic illustration of a driving bogie wherein the first embodiment of the bogie lateral movement-limiting device of the present invention is applied.
Figure 5:
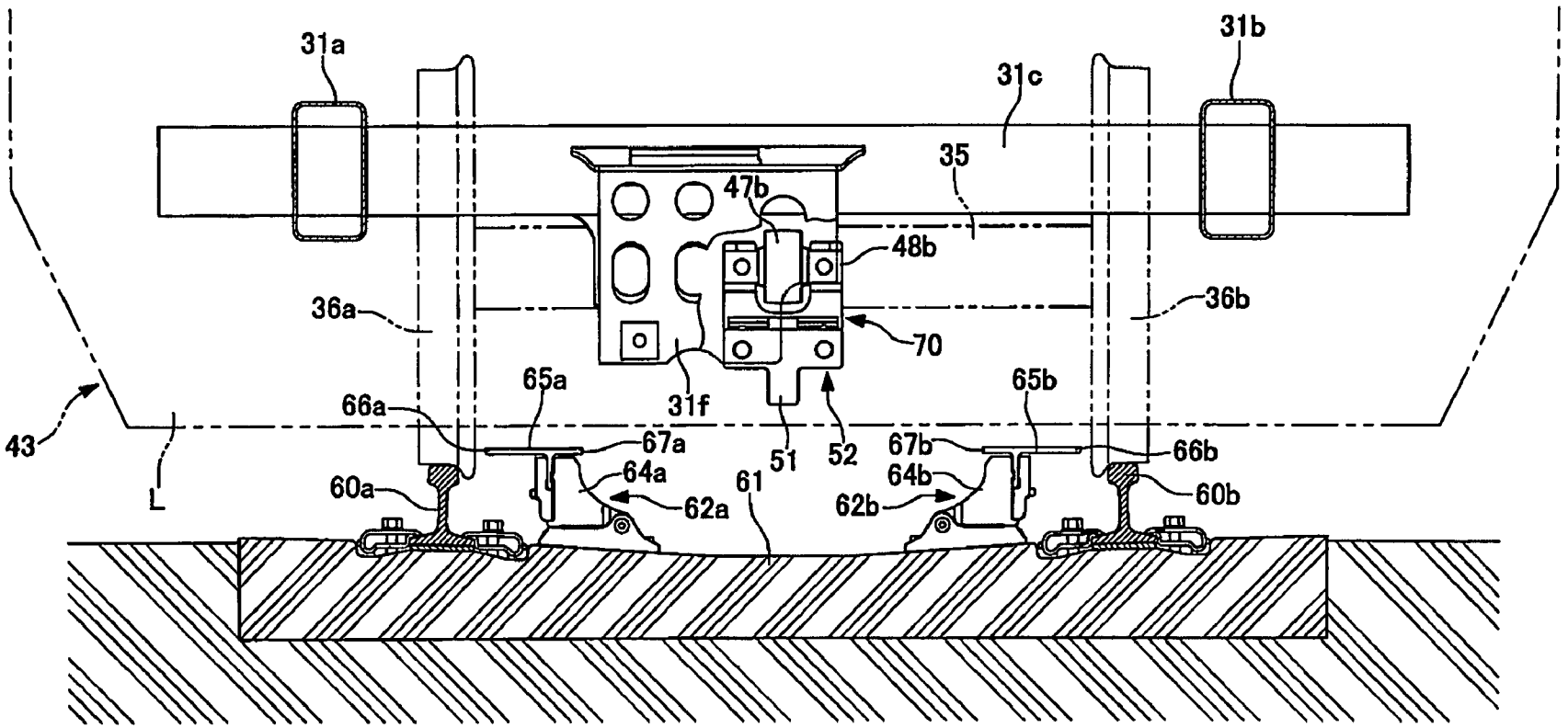
FIG. 5 A front view showing the first embodiment.
Figure 6:
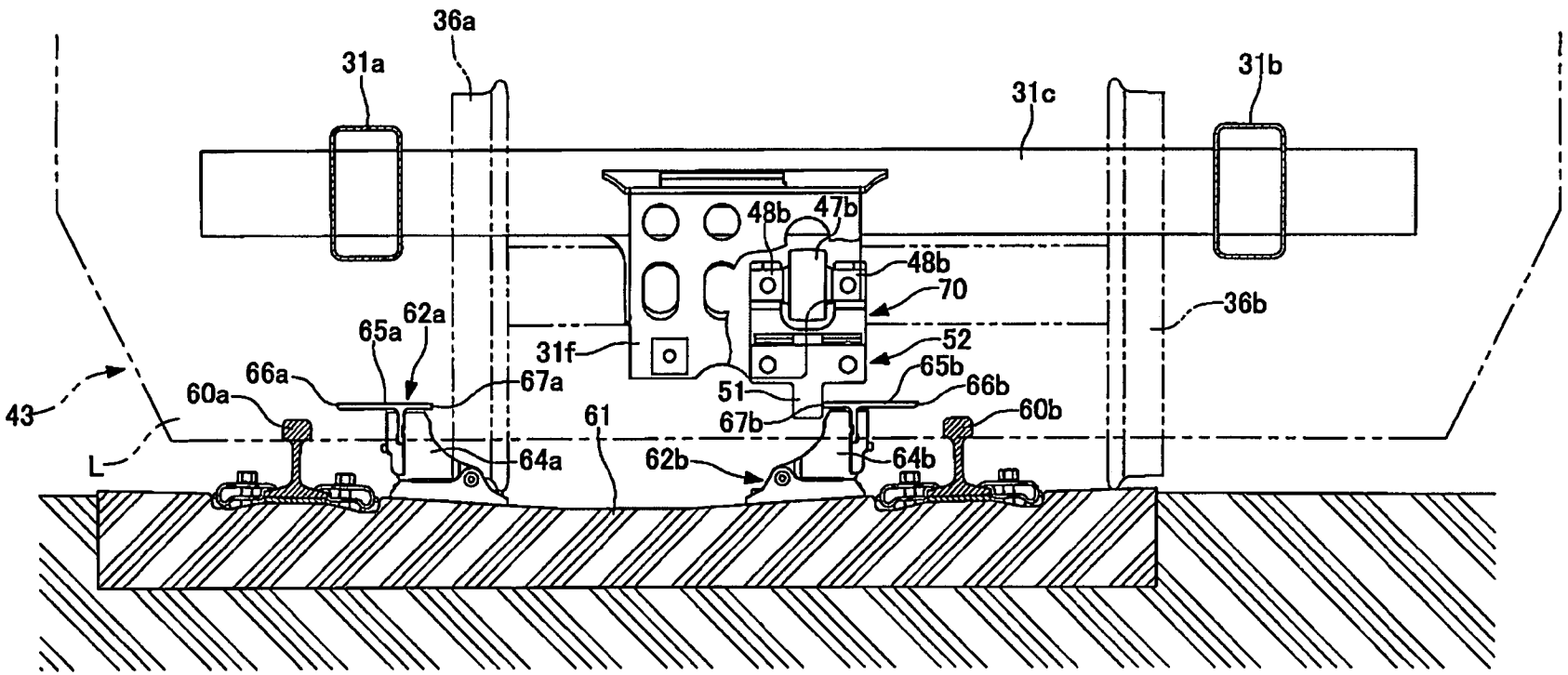
FIG. 6 A front view showing the first embodiment when derailed.
Figure 7:
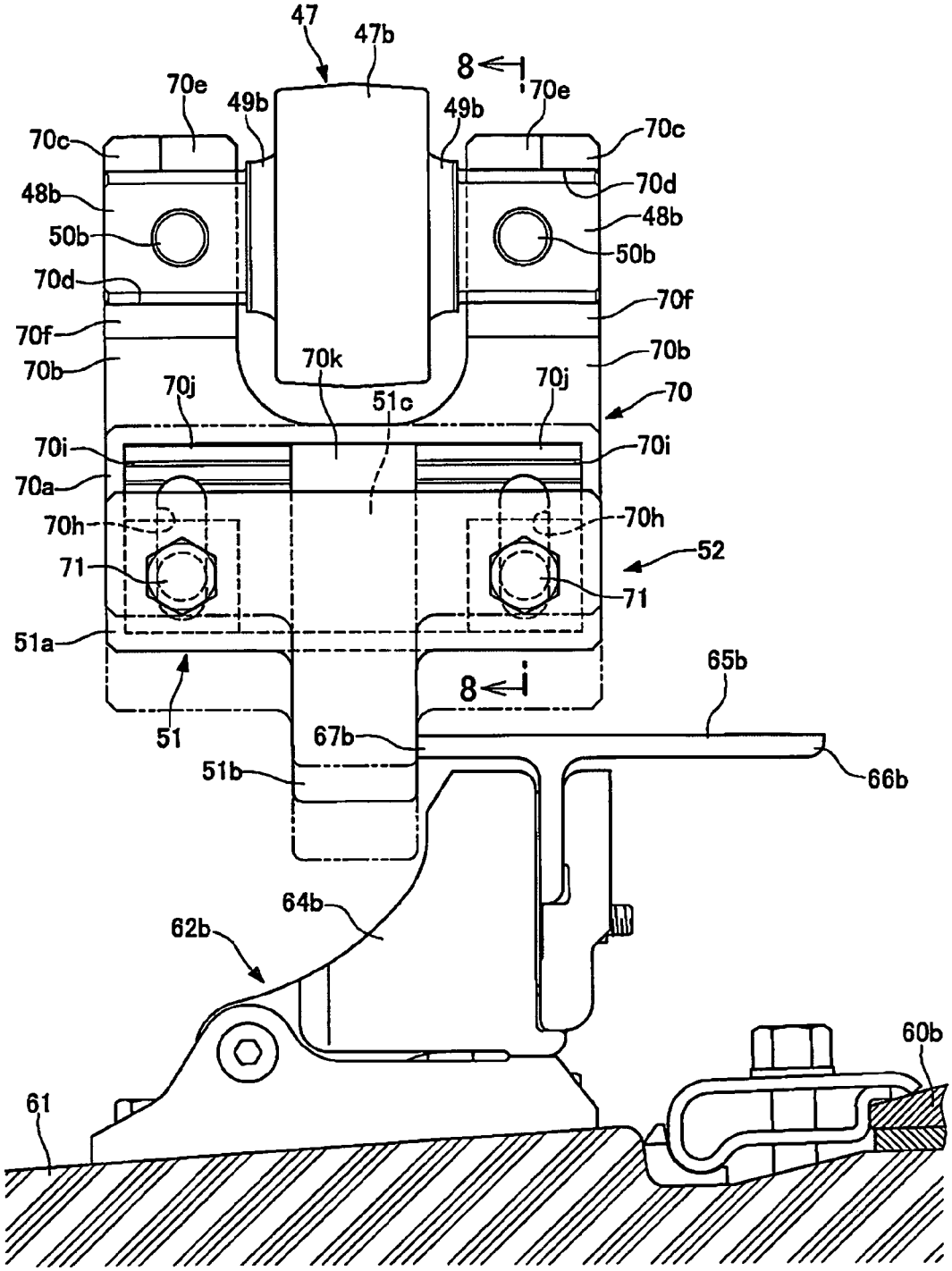
FIG. 7 A front view showing a key part of the first embodiment.
Figure 8:
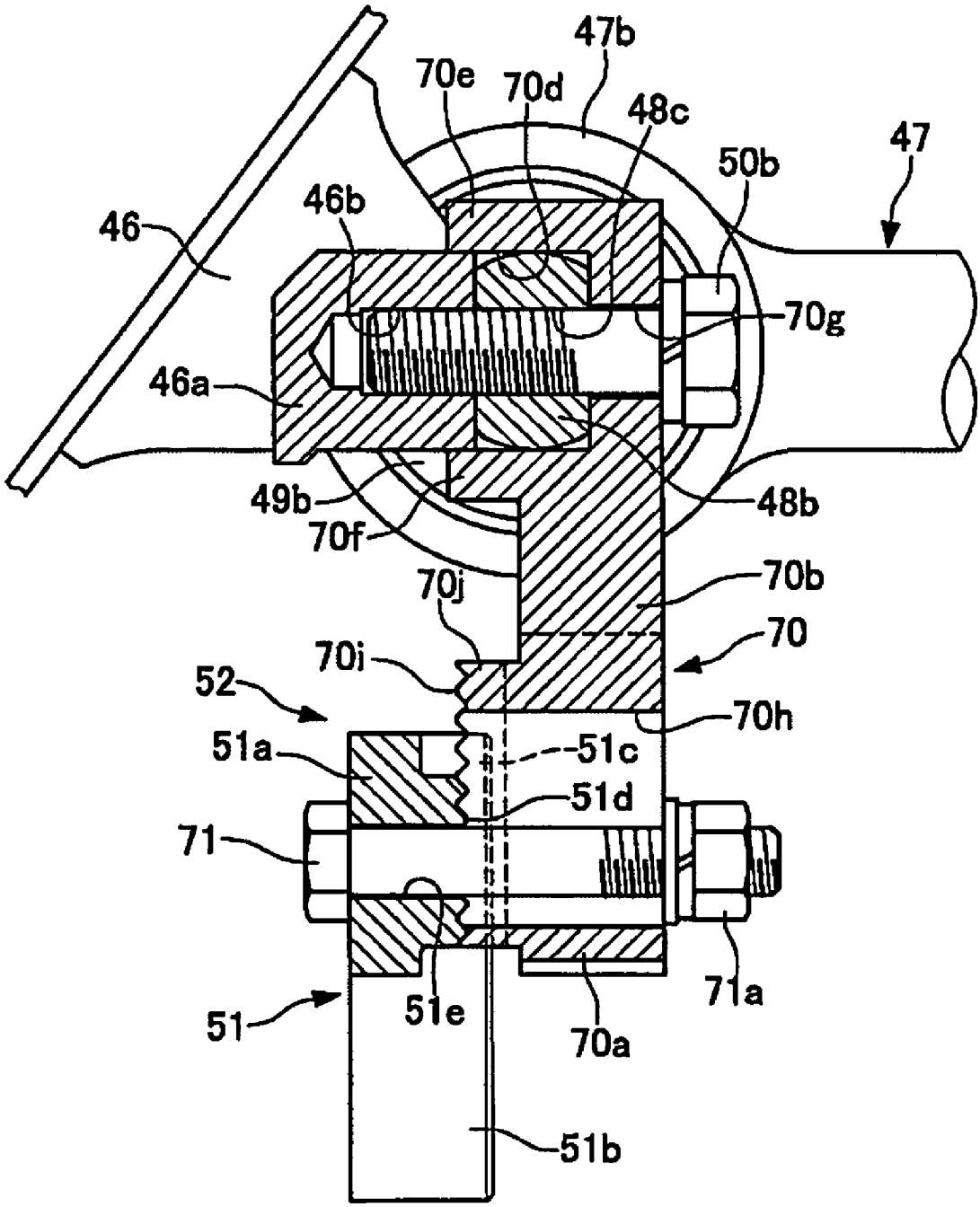
FIG. 8 A sectional view along the line 8-8 in FIG. 7.

The traction device 44 is, as shown in FIG. 4, a single-link type, wherein one link 47 connects between a link bracket on carbody 45 attached to a bottom of the underframe 43*a* of the carbody 43 and a link bracket on bogie side 46 attached to a bracket 31*f* on cross beam 31*c*. Both end portions 47*a* and 47*b* of the link 47 are formed to be ring shapes. In the ring portion of one end portion 47*a*, a rubber bush 49*a* provided to a pin 48*a* in the horizontal direction is force-fitted. The pin 48*a* is firmly fixed to a lower end of the link bracket on carbody 45 with bolts 50*a* to be in parallel with the sleepers 61. In the ring portion of the other end 47*b*, a rubber bush 49*b* provided to the pin 48*b* in the horizontal direction is force-fitted. The pin 48*b* is firmly fixed to the end 46*a* of the link bracket on bogie 46 by bolts 50*b* to be in parallel with the sleepers 61. The link bracket on bogie 46 is attached with a lateral movement-limiting device 52 having a stopper 51 extended downward.

Along inside of the right and left rails 60*a* and 60*b*, derailment prevention guards 62*a* and 62*b* are provided. The derailment prevention guards 62*a* and 62*b* can be provided to the whole length of the railway, however, particularly, it is preferable that they are provided in a high-speed traveling section. The derailment prevention guards 62*a* and 62*b* comprise fixing members 64*a* and 64*b* attached to right and left of a concrete roadbed on a slab track or the sleepers 61 on a ballasted track and T-shaped guard members 65*a* and 65*b* attached to upper parts of the fixing members 64*a* and 64*b*. Heights of the guard members 65*a* and 65*b* are set to be same or slightly higher than the top of the rails 60*a* and 60*b*.

In case the wheel 36*b* on one side floats and a flange of the wheel 36*b* is about to climb over the rail 60*b* due to shakes by an earthquake, etc., as a result that the inner surface of the other wheel 36*a* slidingly contacts with the rail-side portion 66*a* of the guard member 65*a*, derailment of the wheel 36*a* to the inner side of the track is prevented and the flange of the wheel 36*b* is prevented from going over the rail 60*b*. As a result, the wheels 36*a* and 36*b* are prevented from being derailed from the rails 60*a* and 60*b* without interfering with the vehicle running.

In case the flange of one wheel 36*b* goes over the rail 60*b* and the other wheel 36*a* goes over the derailment prevention guard 62*a* to the derailment due to a big shake, it is formed that a side surface of the stopper 51 slidingly contacts with a inner portion 67*b* of the guard member 65*b* to restrict further movement of the bogie 30 in the derailment direction without interfering with the vehicle running. According to this lateral movements of the derailed bogie 30 are limited, and derailment to be out of the track outside and an overturn of the vehicle can be prevented, and as a result a second disaster caused by the derailment can be prevented.

The first embodiment of the bogie lateral movement-limiting device of the present invention is explained with reference to FIG. 4 to FIG. 9. Note that identical components as those shown in FIG. 1 to FIG. 3 are given identical reference numbers respectively and detailed explanations thereon are omitted in the following description. The lateral movement-limiting device 52 of the first embodiment comprises an attachment for the stopper 70 firmly fixed to the link bracket on bogie 46 and the stopper 51 attached to the lower part of the attachment 70. The attachment 70 extends arms 70*b* and 70*b* to both sides from the upper part of the base 70*a*, formed by a square-shaped plate. The distance between the two arms 70*b* and 70*b* is slightly longer than a width of the rubber bush

49*b*. On the side of the link bracket of the bogie of upper side of the two arms 70*b* and 70*b*, attachment for mounting on the link bracket on bogie 70*c* and 70*c* are provided. On each of the attachment for mounting on the link bracket 70*c*, a concave groove 70*d* is provided to fit the entire pin 48*b* on the part of the tip 46*a* of the link bracket on bogie 46. The concave groove 70*d* has a rotation stopper on upper side 70*e* and another rotation stopper on lower side 70*f* so that the entire pin 48*b* and a part of the tip 46*a* of the link bracket on bogie 46 are fit therein.

On a back of the concave groove 70*d*, a bolt hole 70*g* is formed for the bolt 50*b* to insert. The entire pin 48*b* and a part of the tip 46*a* of the link bracket on bogie 46, fitted in the concave groove 70*d*, are firmly fixed to the two arms 70*b* by the bolt 50*b* inserted to the bolt hole 70*g*. On both sides of the base portion 70*a*, bolt holes 70*h* and 70*h* being long in the vertical direction are formed. On both sides of the stopper attaching surfaces of the base portion 70*a*, square-shaped stopper fixing portions 70*j* and 70*j*, having an engagement portion 70*i* having lateral serrations (grooves and ridges) are provided. Between the stopper fixing portions 70*j* and 70*j*, a guide groove 70*k* is formed in vertical direction.

The stopper 51 is formed to have a T-shape by a square-shaped base portion 51*a* and projections 51*b* extended downward from the center of the base portion 51*a*. At the center of the base portion 51*a*, a sliding-contact portion 51*c*, guided to the guide groove 70*k*, is provided to extended to the direction of the attachment. On both sides of the sliding-contact portion 51*c*, mounting faces 51*d* and 51*d* having lateral serrations are formed to be engaged with the engagement portion 70*i*. On the mounting faces 51*d* and 51*d* of the base portion 51*a*, bolt holes 51*e* and 51*e* for bolts 71 and 71 to mount the stopper 51 to the attachment 70 are formed corresponding to the bolt holes 70*h* and 70*h*.

In the state where the mounting face 51*d* is engaged with a preset position of the engagement portion 70*i* and the projection 51*b* is brought to protrude downward with a preset amount, the stopper 51 is integrated by inserting the bolt 71 through the bolt hole 51*e* and 70*h* and tightening it with a nut 71*a*. The integrated stopper 51 is attached to the link bracket on bogie 46 by fitting the end portion of the pin 48*b* and a part of the tip 46*a* of the link bracket on bogie 46 respectively in the concave groove 70*d*, inserting the bolt 50*b* in the bolt hole 70*g* and 48*c* of the pin 48*b*, and tightening with a female screw hole 46*b* provided to the link bracket on bogie 46.

For example, in case that one wheel 36*b* goes over the rail 60*b* and the other wheel 36*a* goes over the derailment prevention guard 62*a* to result in derailment due to a big quake, a side face of the stopper 51 slidingly contacts with the track inner portion 67*b* of the guard member 65*b* and the bogie 30 is restricted not to move to the derailment direction any more without interfering traveling of the vehicle.

Figure 9:
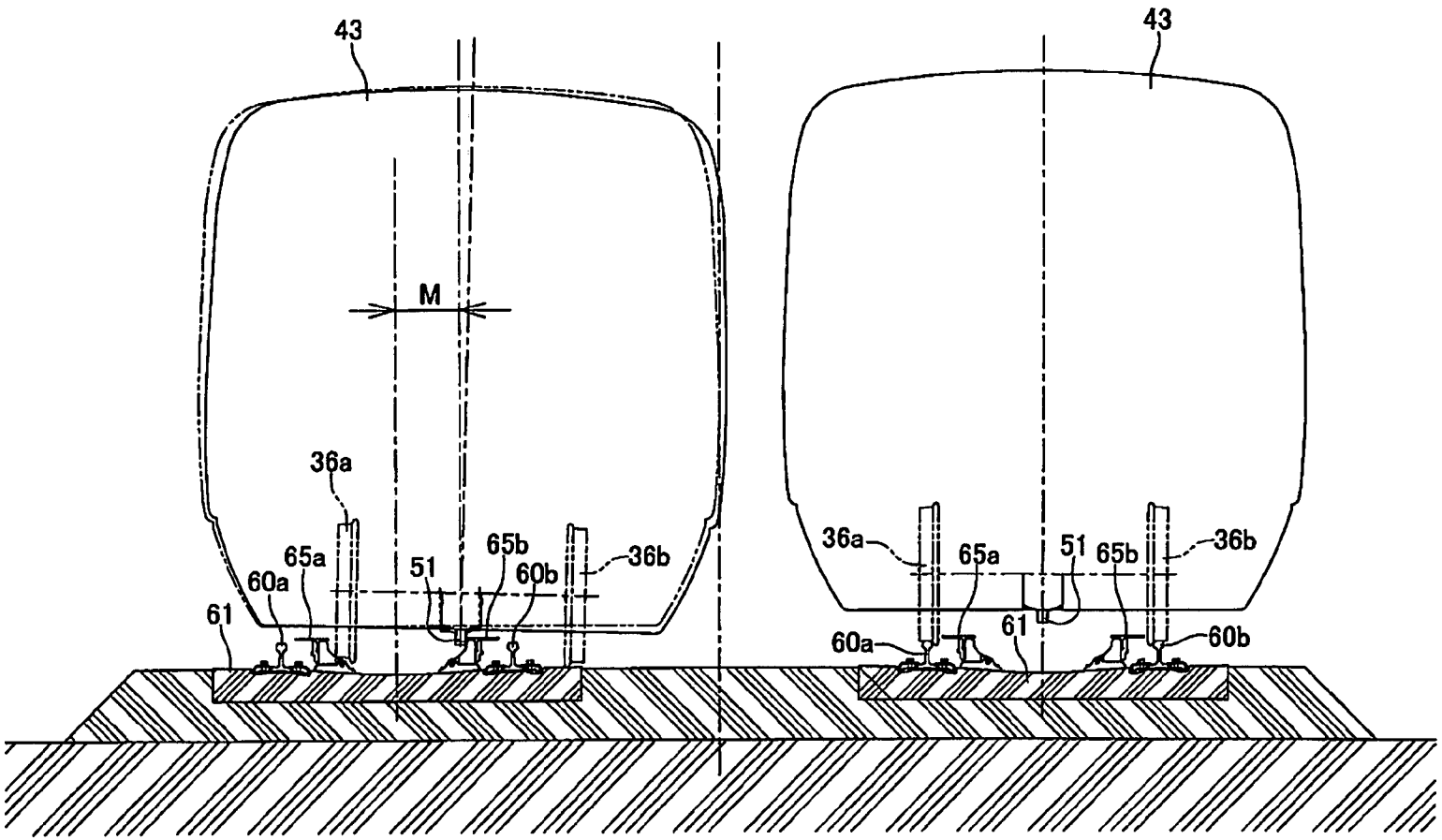
FIG. 9 An explanatory view showing a derailed vehicle and a not-derailed vehicle traveling on the opposite directions on a double track.

An explanation will be made, with reference to FIG. 9, on states of the derailed vehicle in the case where the stopper 51 slidingly contacts with the guard member 65*b* to restrict the bogie 30 not to move to the derailment direction any more without interfering traveling of the vehicle as explained above and a not-derailed vehicle. Since the lateral movement limiting width M can be set based on a relationship of a position of the track inner portion 67*b* of the guard member 65*b* and a position of the side face of the stopper 51, it is preferable that a distance between the track inner portion 67*b* and the side face of the stopper 51 is set to be about ½ of an interval of carbodies 43 of a trains running on a double track section. For example, when a distance between centers of tracks of the double track is 4200 mm at minimum in a straight section and a width of the clearance limit for rolling stock is 3400 mm, an actual width of the carbody is about 3380 mm; therefore, an interval between carbodies in the train coming from the opposite direction becomes about 820 mm. Accordingly, by setting the lateral movement limiting width M to 410 mm or narrower, a collision between the trains running in the opposite directions can be prevented even if both of the vehicles passing each other on double track are derailed to the inner direction, furthermore, even if the derailed carbodies slightly tilt inside; so that a second disaster caused by a collision of the derailed carbodies can be prevented.

Since the lateral movement-limiting device 52 has bolt holes 70*h* on the attachment 70, a vertical position of the stopper 51 can be easily adjusted. Also, when a wheel diameter becomes smaller due to the wheel turning, by changing the attaching position of the stopper 51 to be higher with respect to the attachment 70, the stopper 51 can be prevented from projecting downward to be lower than the clearance limit for rolling stock L.

Furthermore, since the attachment 70 and the stopper 51 are connected by means of the engagement portion 70*i* and the serration face 51*d* and the sliding-contact portion 51*c* is guided to the groove 70*k*, positional deviation of the stopper 51 due to vibration during running etc. can be surely prevented. In addition, when the stopper 51 slidingly contacts with the derailment prevention guard in case of derailment, a load imposed on the stopper 51 can be surely reacted on the engagement faces between the engagement portion 70*i* and the serration face 51*d* and on the contact faces between the sliding-contact portion 51*c* and the guide groove 70*k*.

Also, by attaching the lateral movement-limiting device 52 to the link bracket on bogie 46 used for the single-link type traction link, the projection 51*b* of the stopper 51 can be easily provided at the center position between the wheels; so that one lateral movement-limiting device 52 is effective for derailment in both directions to the right and to the left. Furthermore, as far as the same type bogies are used, the same lateral movement-limiting device can be installed to both the driving bogies and trailing bogies because the same shapes of link bracket are provided to trailing bogies without traction motors; so that the number of parts can be reduced and maintainability can be improved.

Particularly, as far as a single-link type traction link is used on the bogies, the lateral movement-limiting device having the configuration as explained above can be installed easily to the existing bogies without additional member for attaching the stopper device because the existing bogies also have the same attaching structure for the link bracket on bogie and the pin. Also, by fitting the pin 48*b* and a part of the tip 46*a* of the link bracket on bogie 46 in the concave groove 70*d* of the attachment 70 and tightening together by using bolts 50*b*, a load when lateral movements of the bogie are limited can be received by the pin 48*b* and the link bracket on bogie 46.

Figure 10:
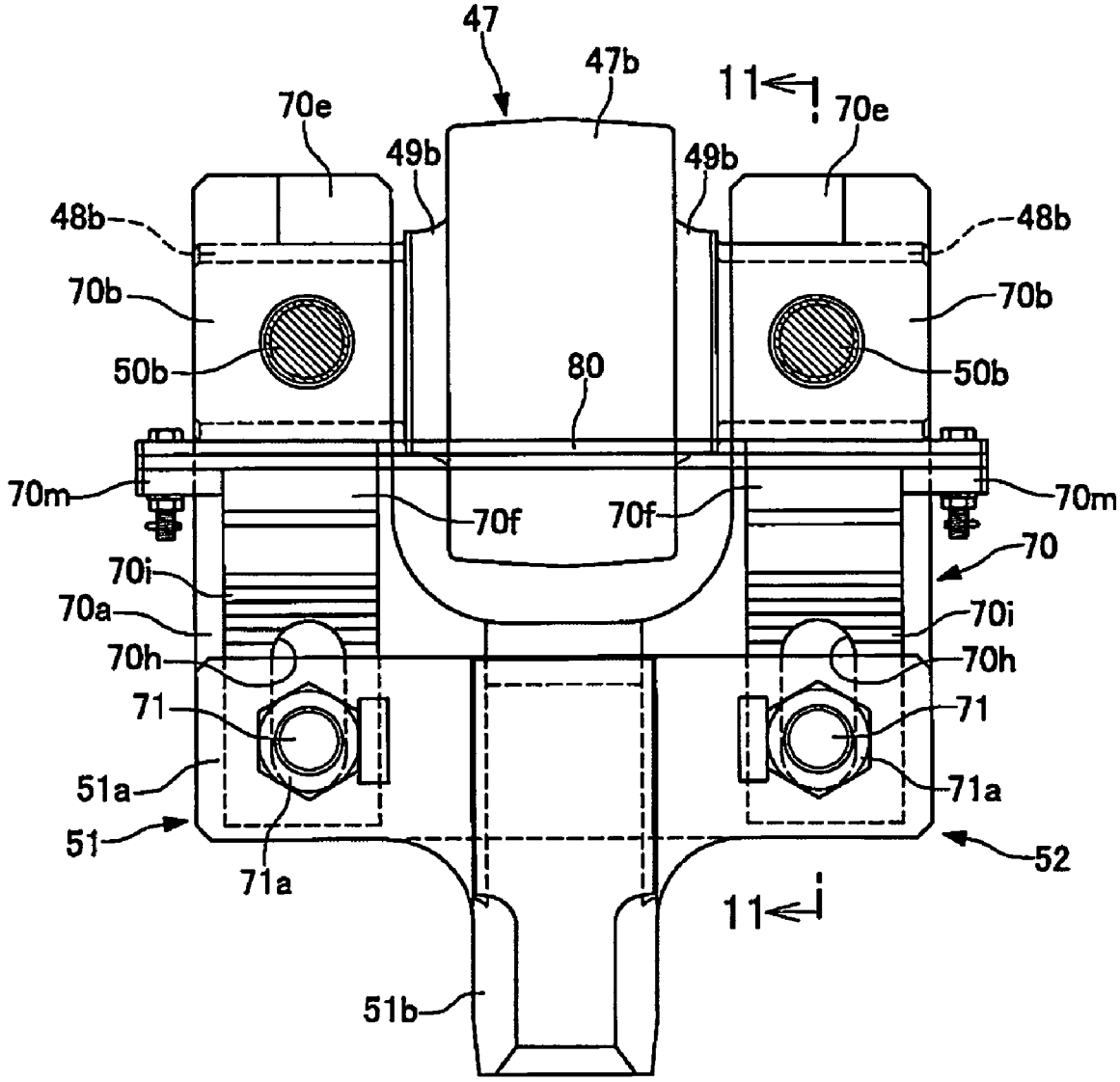
FIG. 10 A front view showing a key part of a second embodiment.
Figure 11:
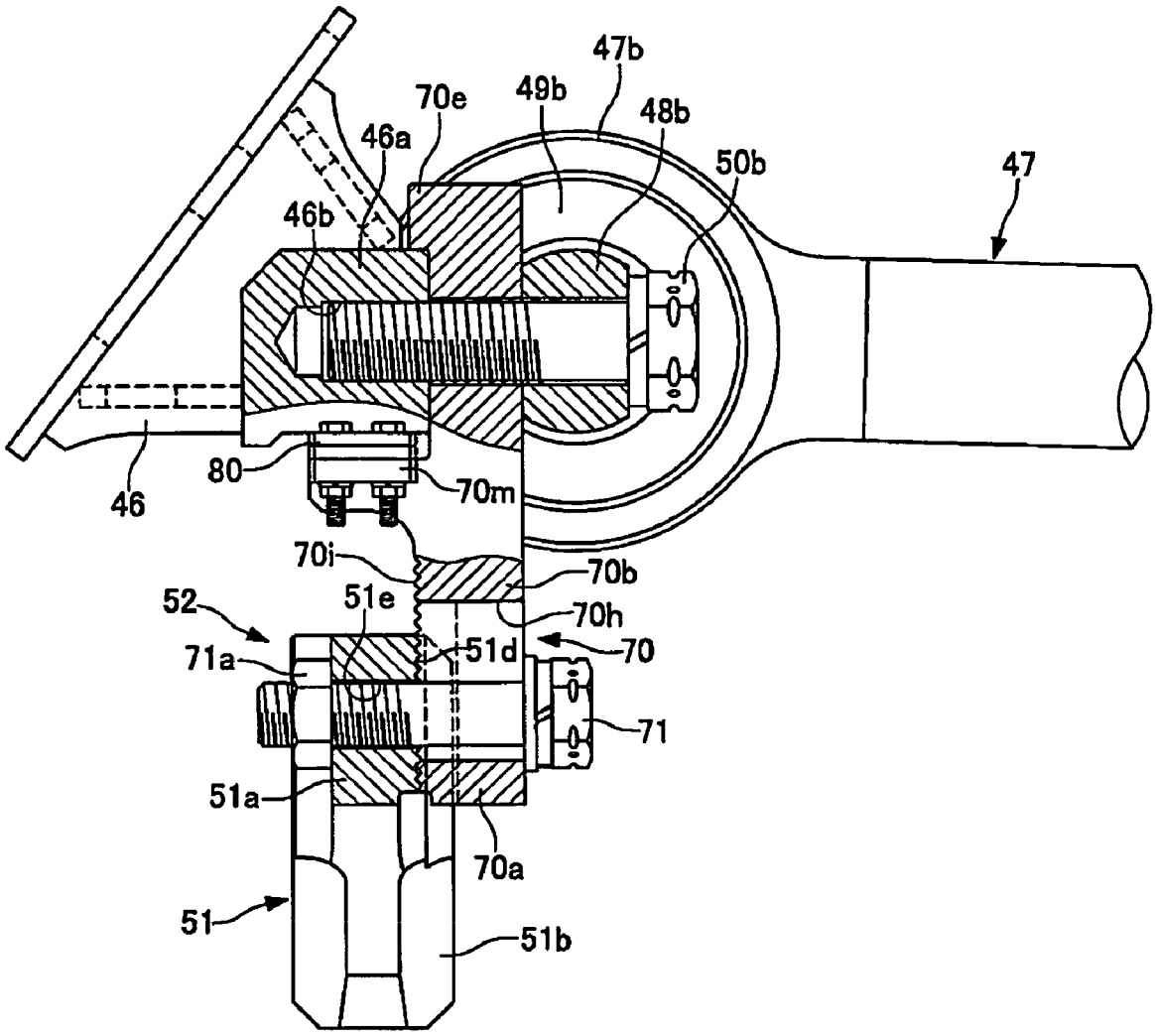
FIG. 11 A sectional view along the line 11-11 in FIG. 10.
Figure 12:
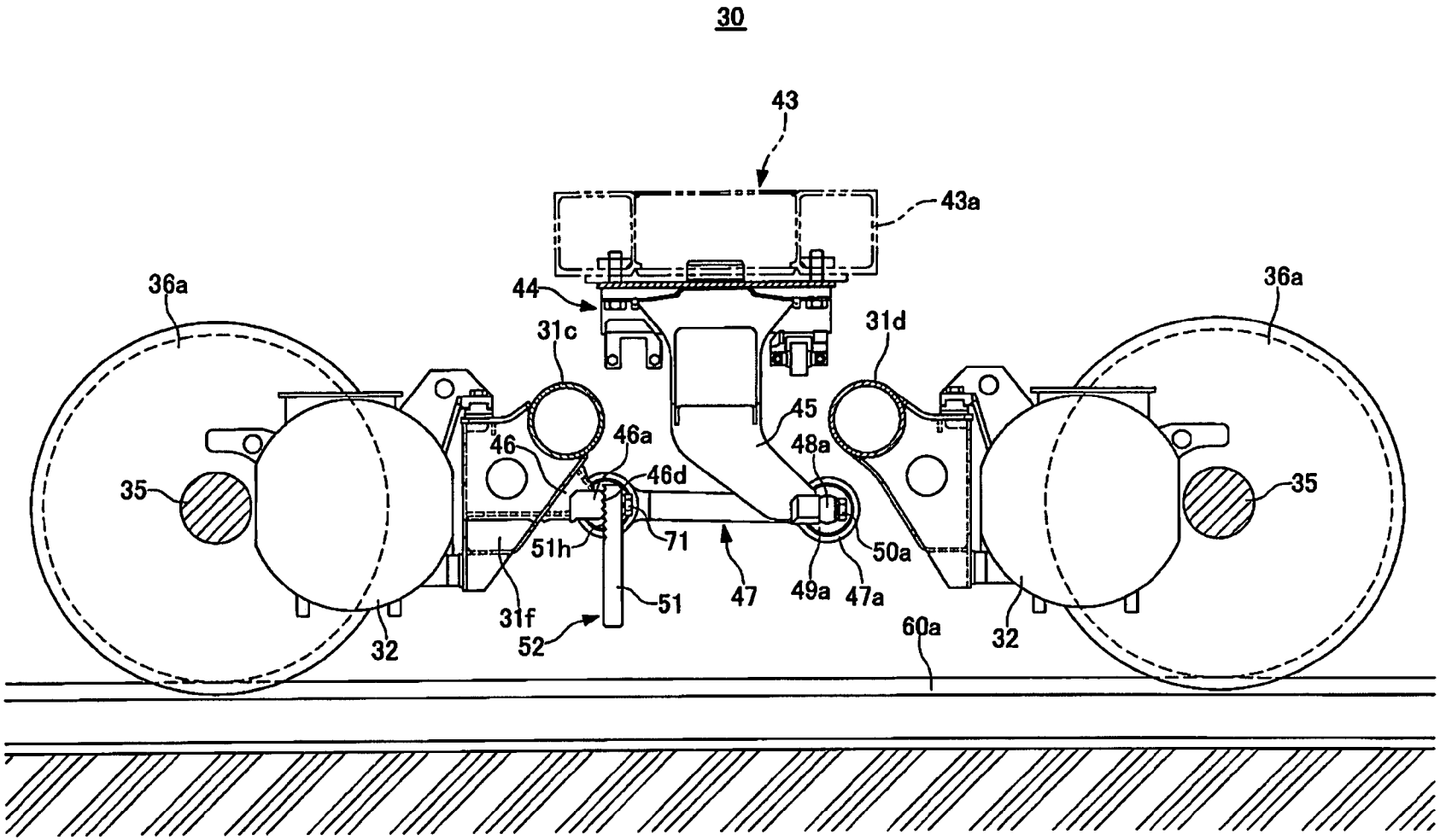
FIG. 12 A side view showing a schematic illustration of a driving bogie wherein a third embodiment is applied.
Figure 13:
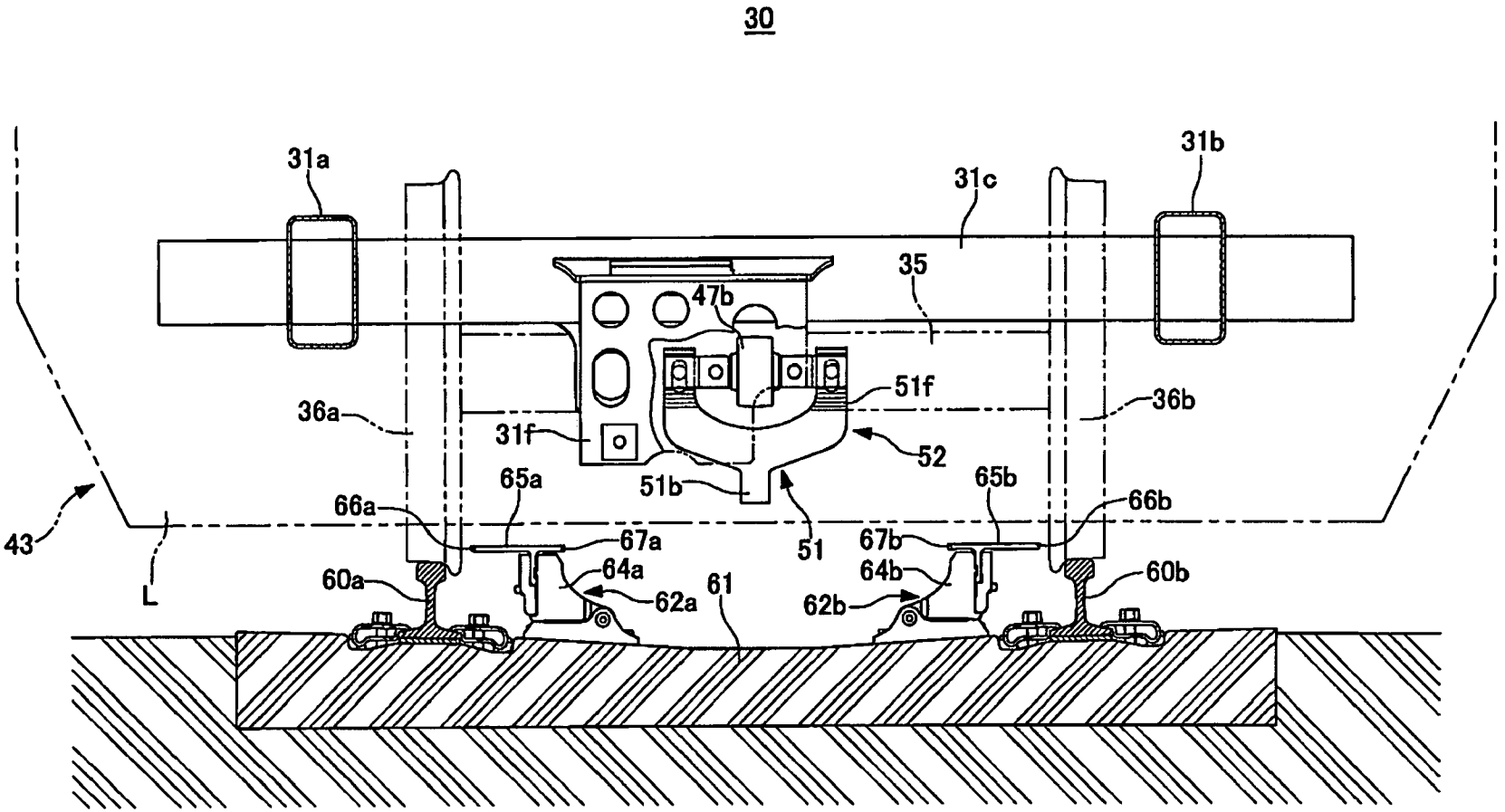
FIG. 13 A front view of the third embodiment.
Figure 14:
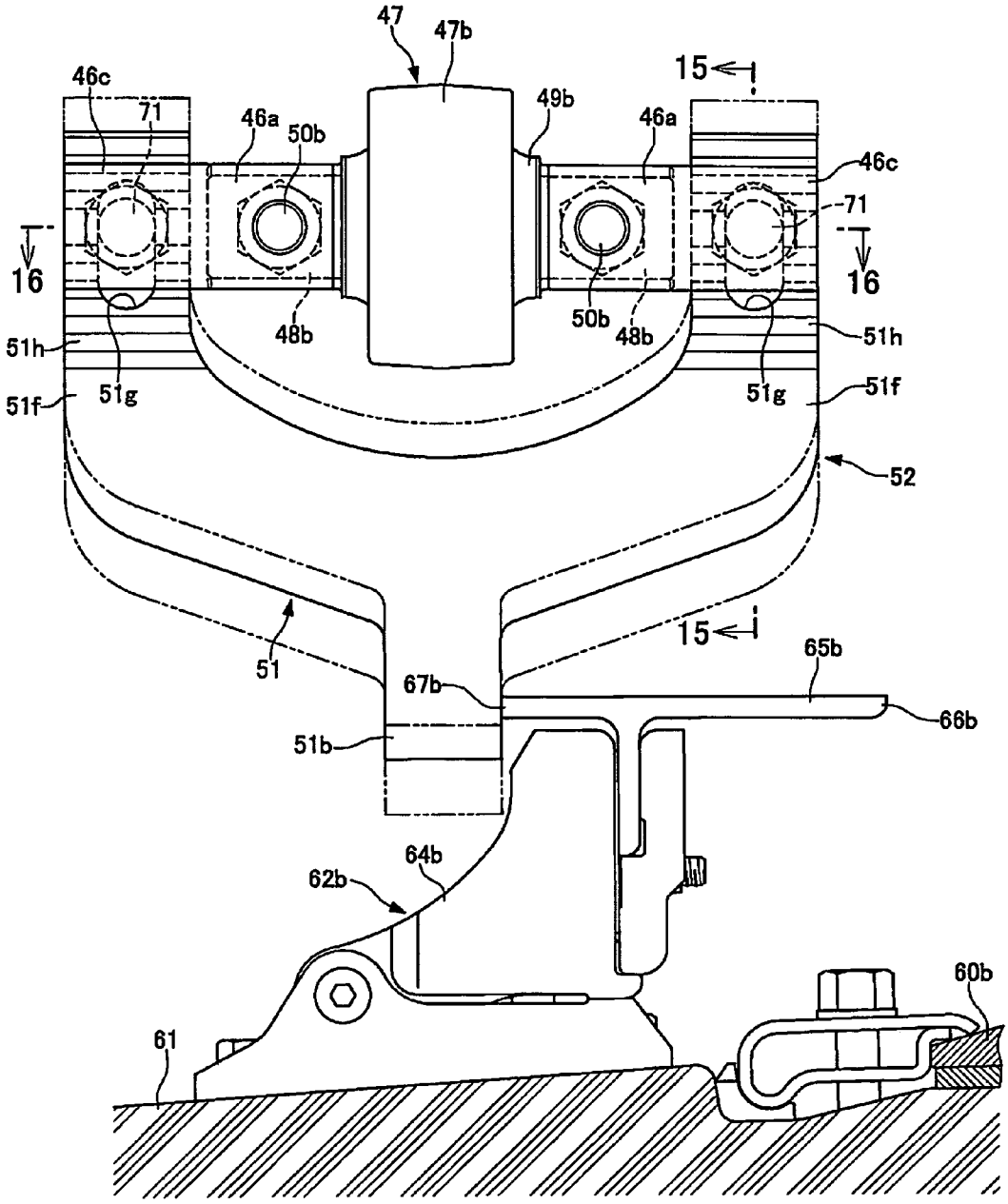
FIG. 14 A front view showing a key part of the third embodiment.
Figure 15:
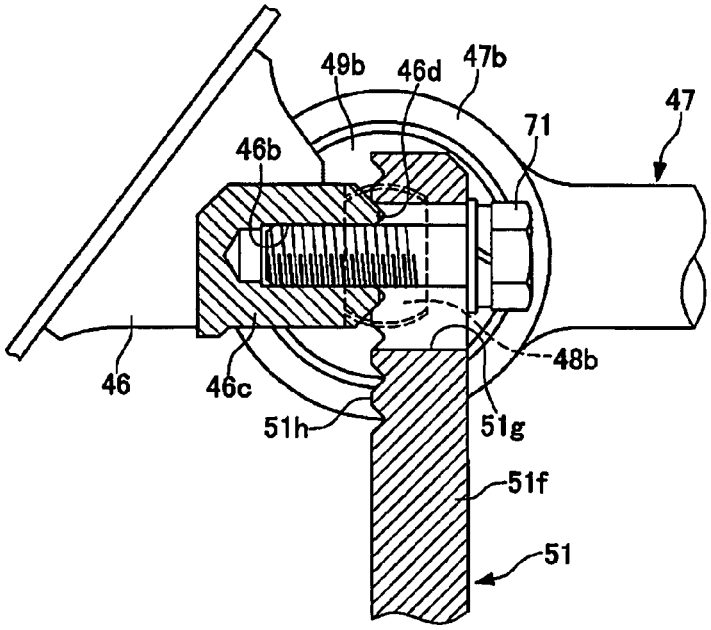
FIG. 15 A sectional view along the line 15-15 in FIG. 14.
Figure 16:
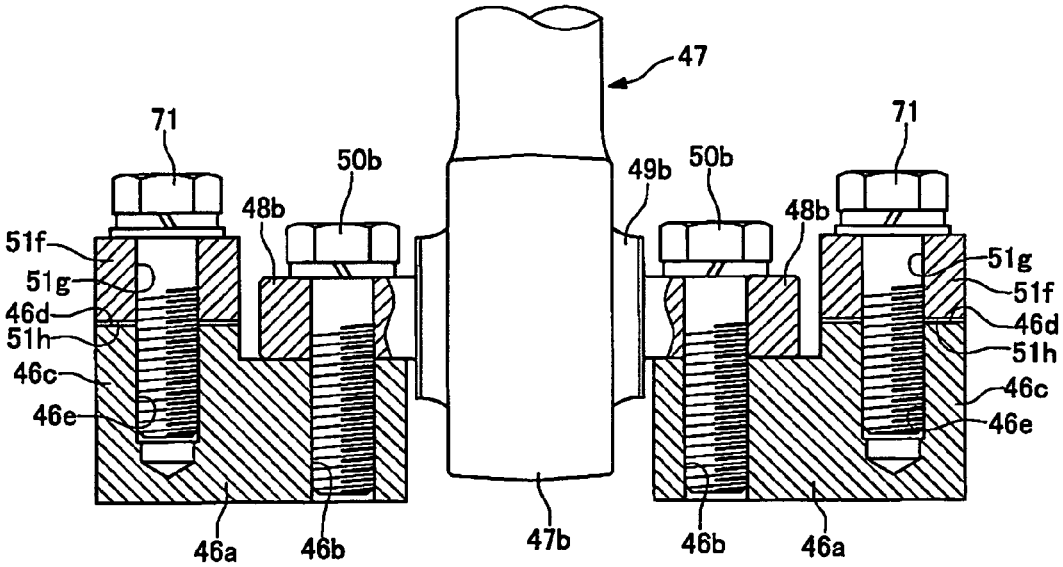
FIG. 16 A sectional view along the line 16-16 in FIG. 14.

A second embodiment of the lateral movement-limiting device of the present invention is explained with reference to FIG. 10 and FIG. 11. Note that, in the following explanations, identical components as those shown in the above first embodiment are given identical reference numbers and detailed explanations thereon are omitted.

In the lateral movement-limiting device 52 of the second embodiment, the arm 70*b* is fixed between the tip 46*a* and the pin 48*b* by using the bolts 50*b* by placing the arm 70*b* of the attachment 70 between tip 46*a* of the link bracket on bogie 46 and the pin 48*b*. An upper side rotation stopper 70*e* and a lower side rotation stopper 70*f* are provided above and beneath the mounting portion of the tip 46*a* of the arms 70*b*. Liners 80 inserted between the lower side rotation stopper 70*f* and the bottom surface of the tip 46*a* is fixed to a bracket 70*m* hanging laterally from the lower side rotation stopper 70*f*. The engagement portion 70*i* on the base portion 70*a* of the attachment 70 and the engagement face 51*d* of the base portion 51*a* of the stopper 51 is connected by means of serrations. Other configurations are almost the same as those in the first embodiment. Note that a means of fixing the tip 46*a* of the link bracket on bogie 46 and the pin 48*b* to the attaching arm 70*b* can be made more compact in the second embodiment comparing with that in the first one.

Figure 17:
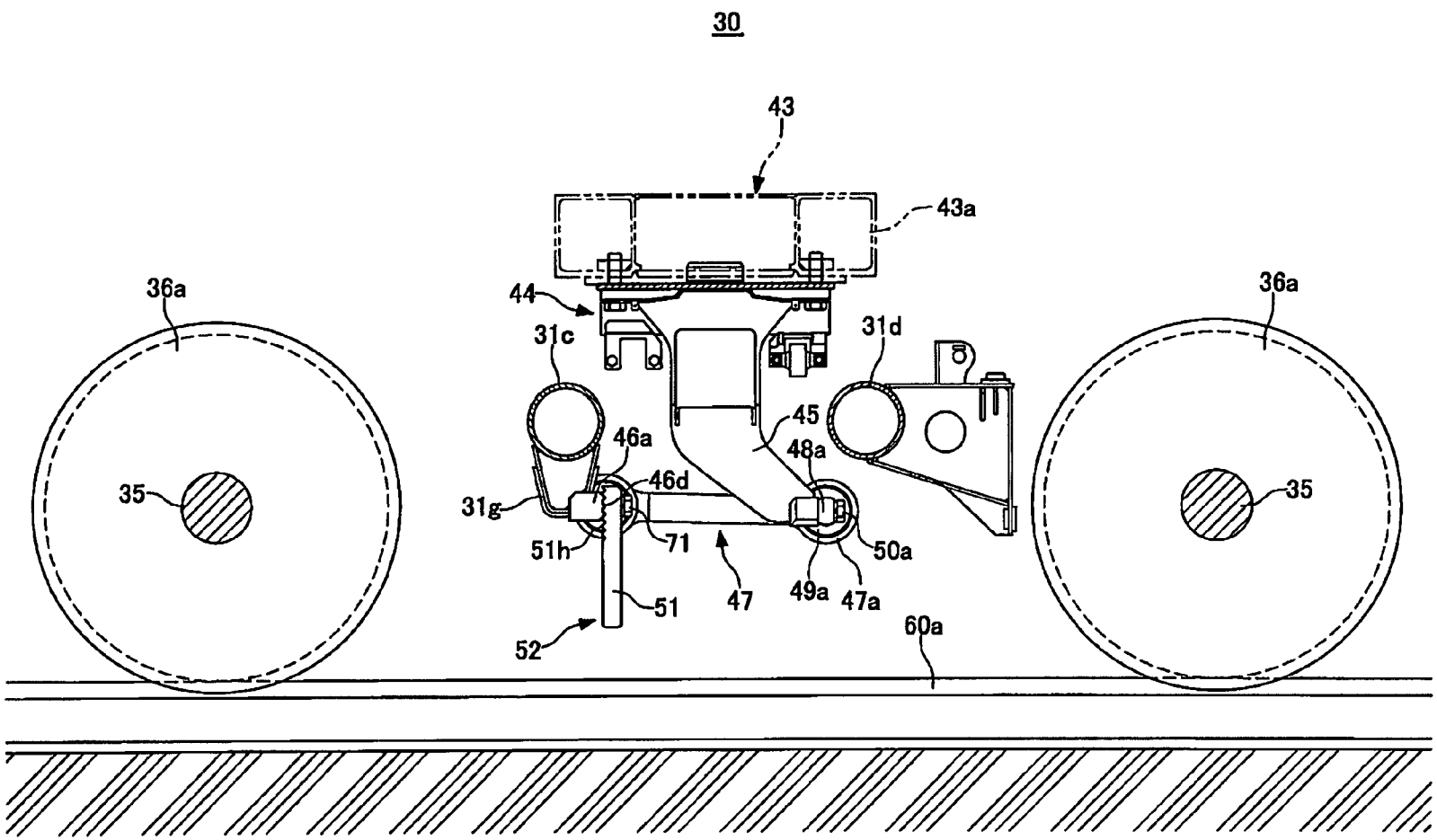
FIG. 17 A side view showing a schematic illustration when the third embodiment is applied to a trailing bogie.
Figure 18:
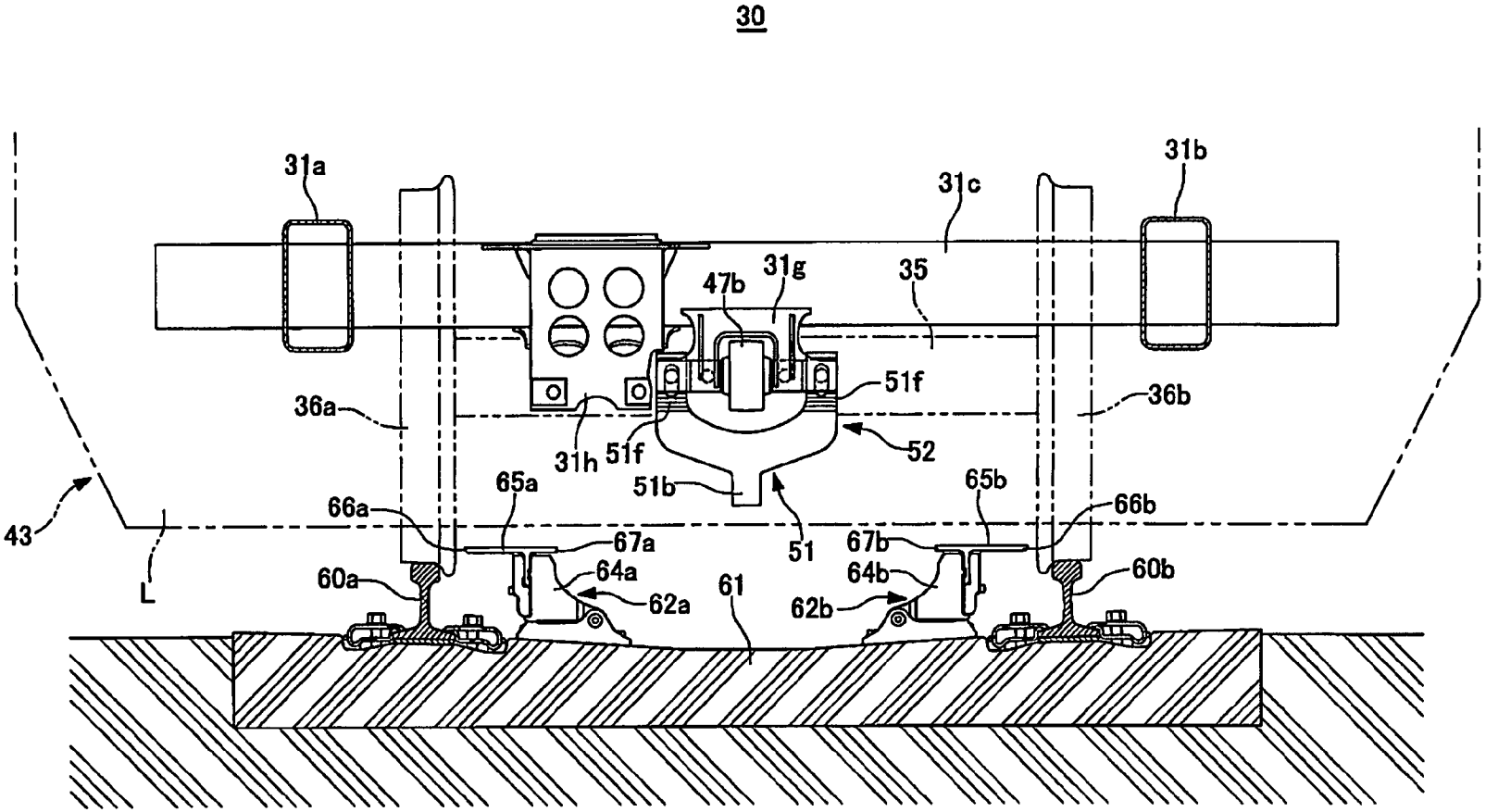
FIG. 18 A front view of FIG. 17.

A lateral movement-limiting device in a third embodiment is explained with reference to FIG. 12 to FIG. 18. FIG. 12 to FIG. 16 show an example of applying to a driving bogie and FIG. 17 and FIG. 18 show an example of applying to a trailing bogie. In FIG. 12 to FIG. 16, this lateral movement-limiting device 52 fixes the stopper 51 to stopper attaching portions 46*c* and 46*c* by bolts 71 and 71, wherein tips 46*a* and 46*a* of the link bracket on bogie 46 are extended and both of the extended portions are used as the stopper attaching portions 46*c* and 46*c*. At the tip portions 46*a* and 46*a*, the pins 48*b* and 48*b* are fixed by bolts 50*b* and 50*b*. In the stopper attaching portion 46*c*, an engagement portion 46*b* and a female screw hole 46*e* for tightening the bolt 71 are provided on the stopper device attaching face.

The stopper 51 is formed to be a Y-shape by a pair of attaching arms 51*f* and 51*f* extended upward to be attached respectively to both of the stopper attaching portions 46*c* and 46*c* and a projection 51*b* extended downward. At an upper part of each of the attaching arms 51*f*, a bolt hole 51*g* being long in the vertical direction is provided for a bolt 71 to be inserted therein, and a face on the side of the stopper attaching portion has an engagement face 51*h* formed thereon.

As explained above, the number of bolts for fixing the stopper 51 can be reduced comparing with that in the first example by attaching the stopper 51 to the stopper attaching portion 46*c* formed by extending the both side portions of the link bracket on bogie 46. Furthermore, space between the attaching arms 51*f* and 51*f* can be widened, so that strength and stability of the stopper 51 can be improved.

In the same way as in the both of the embodiments explained above, positional deviation between the stopper attaching portion 46*c* and the stopper 51 is prevented by the engagement, and a vertical position of the stopper 51 can be adjusted by the bolt hole 51*g*.

An example of applying the lateral movement-limiting device of the third embodiment to a trailing bogie is explained with reference to FIG. 17 and FIG. 18. The lateral movement-limiting device 52 is provided to a bracket 31*g* of a cross beam 31*c* of the trailing bogie. The reference number 31*h* indicates a bracket for braking gear of trailing bogie. The shape and configuration, etc. of the lateral movement-limiting device 52 are the same as those in the third embodiment shown in FIG. 12 to FIG. 16.

A lateral movement-limiting device of a fourth embodiment is explained with reference to FIG. 17 and FIG. 18. The lateral movement-limiting device 52 in this embodiment is made by dividing the stopper in the third embodiment into two members structure: An attachment for the stopper 70 and the stopper 51. The attachment 70 comprises a base portion 70*a* and attaching arms 70*b* and 70*b*. The stopper 51 comprises a base portion 51*a* and a projection 51*b*. The attachment 70 is mounted by fixing the attaching arms 70*b* and 70*b* using bolts 72 and 72 with tip portions of the stopper attaching portions 46*c* and 46*c* fitted in the concave grooves 70*d* and 70*d*. The base portion 70*a* of the attachment 70 has bolt holes 70*h* and 70*h* being long in the vertical direction for the bolts 71 and 71 to be inserted, and an engagement portion 70*i* is formed around each of the bolt hole 70*h*. The engagement portion 70*i* connects with the engagement face 51*d* of the stopper 51, and the stopper 51 is fixed to the attachment 70 by bolts 71. Since the stopper 51 and the attachment 70 are in serration engagement, vertical position is easily adjusted.

Figure 19:
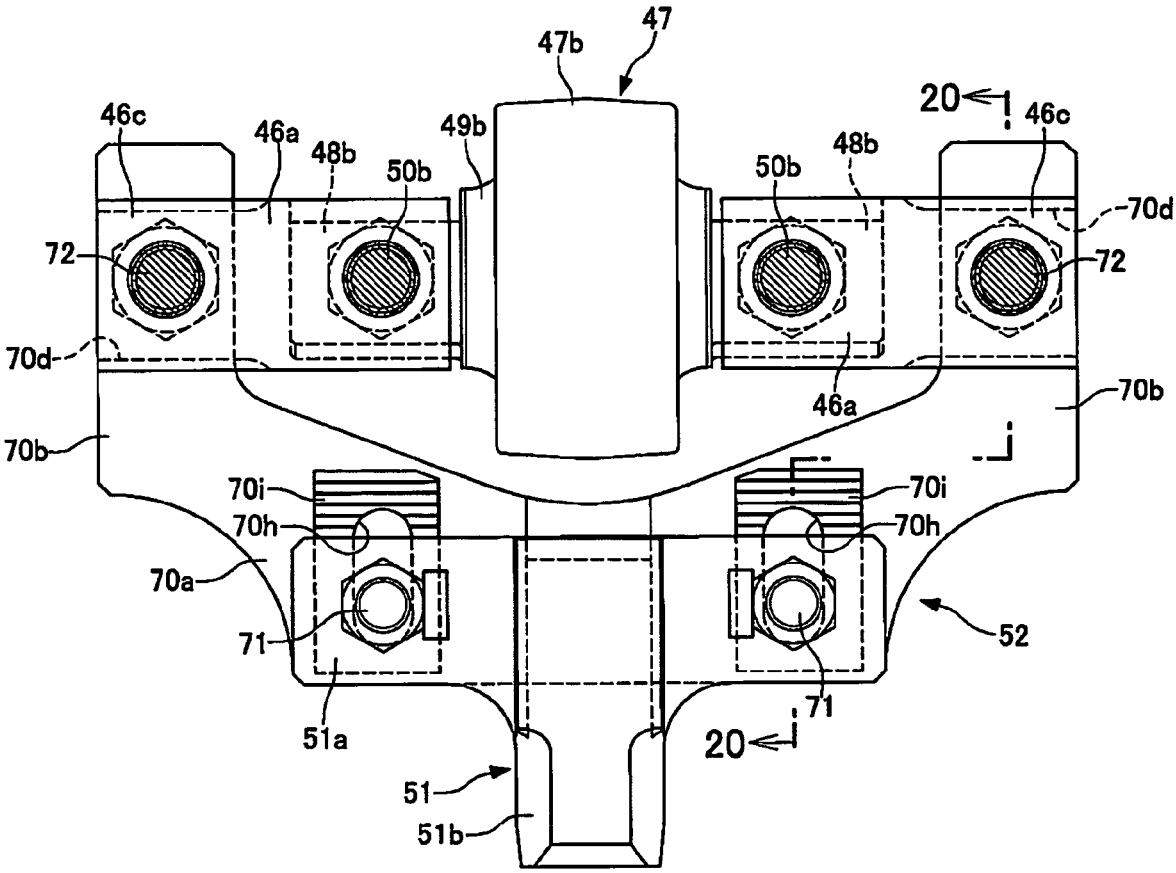
FIG. 19 A front view showing a key part of a fourth embodiment.
Figure 20:
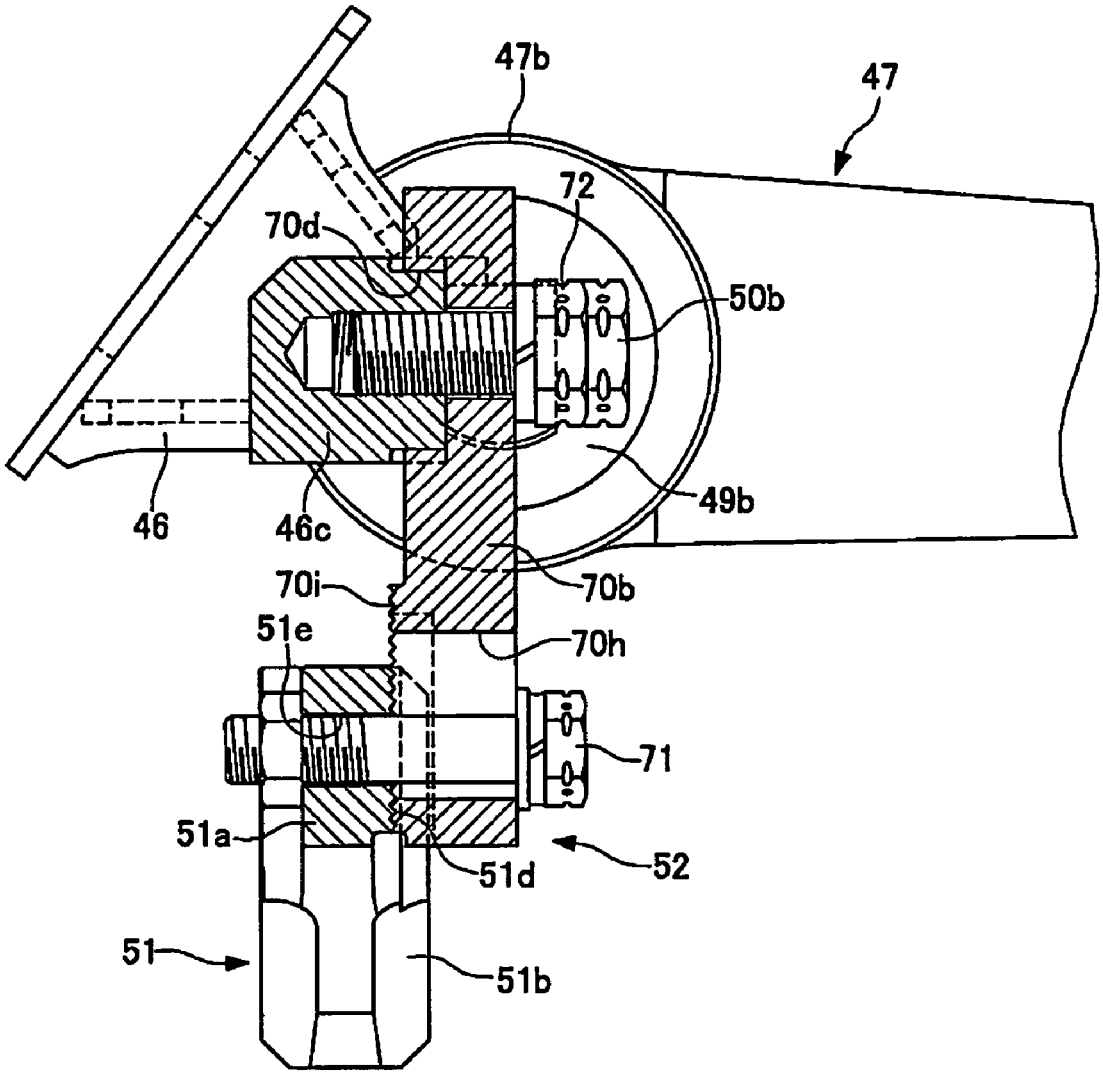
FIG. 20 A sectional view along the line 20-20 in FIG. 19.
Figure 21:
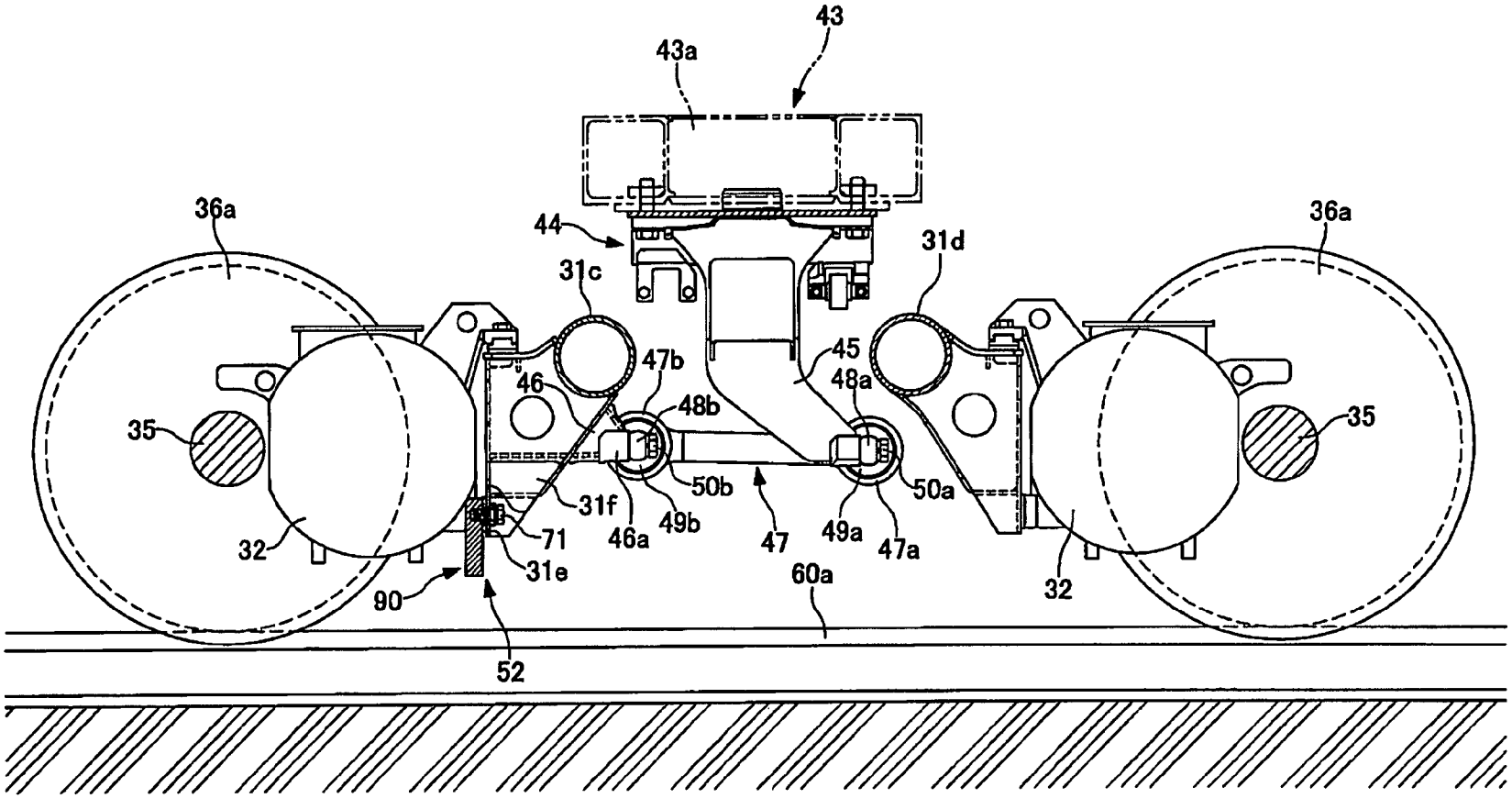
FIG. 21 A side view showing a schematic illustration of a driving bogie wherein a fifth embodiment is applied.
Figure 22:
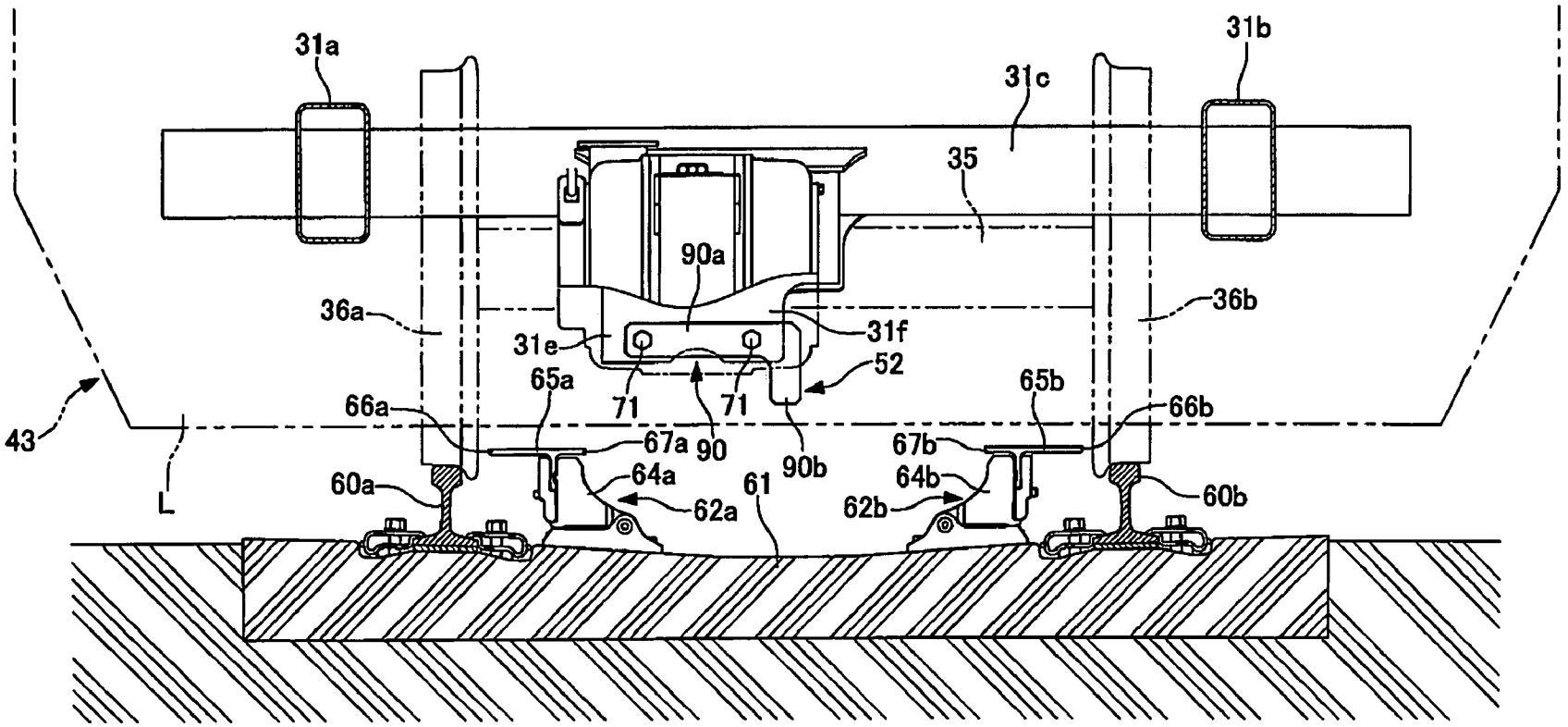
FIG. 22 A front view of the fifth embodiment.

A lateral movement-limiting device of a fifth embodiment is explained with reference to FIG. 19 and FIG. 20. The lateral movement-limiting device 52 is mounted to a stopper attaching portion 31*e* provided to the bracket 31*f* by bolts 71. Note that the traction motor 32 is supported by the cross beam 31*c* via the attaching bracket 31*f*.

A stopper 90 of the lateral movement-limiting device 52 is formed to be an L-shape and comprises a longitudinal attaching arm 90*a* corresponding to the stopper attaching portion 31*e* and a projection 90*b* extended downward from one end of the attaching arm 90*a*. The stopper 90 is fixed to the stopper attaching portion 31*e* by bolts 71 so that the projection 90*b* is arranged at the center portion in lateral direction.

As explained above, in the case of a driving bogie provided with a traction motor 32, a stopper can be attached to the traction motor 32 or an attaching frame thereof, etc. Note that, while a detailed illustration are omitted, by providing an engagement portion on contact faces of the stopper attaching portion 31*e* and the attaching arm 90*a*, respectively, in the same way as explained above, positional deviation of the stopper 90 can be prevented. A position of the stopper 90 in the vertical direction can be adjusted by providing long bolt holes on the attaching arm 90*a* or the stopper attaching portion 31*e*.

Note that, in each embodiment, even though it is possible to provide a derailment prevention guard for preventing derailment of a wheel and a derailment prevention guard for the stopper separately and to install them on the different positions, required cost such as construction and installation can be reduced by giving both of the functions to one derailment prevention guard as explained above. Also, any type the structure of the bogie may be applied, the stopper may be shaped according to the structure of each type of bogies, and similar stoppers may be provided at several positions.

The invention claimed is:

1. A bogie lateral movement-limiting system for restricting lateral movement of a bogie during derailment of a vehicle traveling on paired rails, the system comprising:

a derailment prevention guard device laid along inside of the paired rails within construction gauge; and, a lateral movement-limiting device attached to a lower part of the bogie;

wherein the lateral movement-limiting device has a stopper extending downward from a position inside of wheels of the bogie and within the clearance limit for rolling stock, the stopper being positioned proximate a midpoint of the bogie in the width direction such that interference of the stopper and the derailment prevention guard device is prevented during normal operations, but sliding contact of the stopper and an inner face of a derailment prevention guard is allowed upon derailment.

2. A bogie lateral movement-limiting system of claim 1, which consists of a single stopper.

3. The bogie lateral movement-limiting system as set forth in claim 1, wherein the stopper is adjustable in a downward projection amount thereof.

4. The bogie lateral movement-limiting device as set forth in claim 1, comprising an attachment for the stopper provided to a lower part of the bogie and the stopper being mounted on the attachment;

wherein the stopper is adjustable in a downward projection amount.

5. The bogie lateral movement-limiting device as set forth in claim 1, wherein the stopper is attached to a lower part of the bogie and is adjustable in a downward projection amount.

6. The bogie lateral movement-limiting device as set forth in claim 1, wherein the derailment prevention guard device comprises fixing members to be attached to right and left sides of sleepers and a T-shaped guard member attached to an upper part of each of the fixing members;

and heights of the guard members are set to be same or slightly higher than a top of the rails.

* * * * *